US011473883B1

(12) United States Patent
Sooter

(10) Patent No.: US 11,473,883 B1
(45) Date of Patent: Oct. 18, 2022

(54) CASELESS TAPERED-BORE AMMUNITION AND FIREARM

(71) Applicant: Dennis Paul Sooter, Maryville, TN (US)

(72) Inventor: Dennis Paul Sooter, Maryville, TN (US)

( * ) Notice: Subject to any disclaimer, the term of this patent is extended or adjusted under 35 U.S.C. 154(b) by 0 days.

(21) Appl. No.: 17/525,319

(22) Filed: Nov. 12, 2021

(51) Int. Cl.
*F42B 5/18* (2006.01)
*F41A 21/18* (2006.01)

(52) U.S. Cl.
CPC ..... *F42B 5/182* (2013.01); *F41A 21/18* (2013.01)

(58) Field of Classification Search
CPC .. F42B 5/18; F42B 5/181; F42B 5/182; F41A 21/16; F41A 21/18
USPC ..... 102/431; 42/76.01; 89/14.05
See application file for complete search history.

(56) References Cited

U.S. PATENT DOCUMENTS 1,944,883 A * 1/1934 Gerlich ..... F41A 21/16 89/14.05
2,091,635 A * 8/1937 Hayden ..... F42B 12/625 102/490
2,121,796 A * 6/1938 Helbich ..... F42B 14/02 42/76.01
2,345,089 A * 3/1944 Born ..... F41A 21/16 42/78
2,423,453 A * 7/1947 Howe ..... F41A 21/16 89/14.6
2,687,591 A 8/1954 Lamb et al.
3,011,404 A * 12/1961 Russell ..... F42B 5/10 42/76.01
3,412,681 A 11/1968 Hans-Ludwig
3,468,216 A * 9/1969 Charpentier ..... F41A 21/16 89/14.05
3,485,170 A 12/1969 Scanlon
3,547,001 A 12/1970 Stoner
3,848,530 A * 11/1974 Plumer ..... F42B 5/18 102/433
4,126,955 A 11/1978 Coffield, Jr. et al.
4,527,348 A * 7/1985 Brennan ..... F41A 21/28 89/14.05
7,210,260 B1 * 5/2007 Smalley, Jr. ..... F42B 5/025 89/14.05

(Continued)

FOREIGN PATENT DOCUMENTS

DE 2838208 A * 7/1982 ..... F41A 21/16
GB 521345 A 5/1940

*Primary Examiner* — Bret Hayes
(74) *Attorney, Agent, or Firm* — Luedeka Neely Group, P.C.

(57) ABSTRACT

A caseless ammunition cartridge includes a unitary outer portion having forward, central section and rear sections. The forward section has an aerodynamic tangent ogive profile. The rear section has a cylindrical profile. The central section has a conical profile that transitions from the radius of the forward section to the radius of the rear section. An inner core, disposed within the unitary metallic outer portion, has a front portion encased by the forward section of the unitary outer portion, and a cylindrical rear portion disposed within the central and rear sections of the unitary outer portion. An annular cavity is disposed between the unitary outer portion and the rear portion of the inner core. A propellant is disposed within the annular cavity. A combustible seal covers the annular cavity to protect the propellant.

12 Claims, 7 Drawing Sheets

(56) References Cited

U.S. PATENT DOCUMENTS

| | | | | |
|---|---|---|---|---|
| 8,863,421 | B1 * | 10/2014 | Farage | F41A 3/10 102/431 |
| 9,746,298 | B2 | 8/2017 | Minnicino | |
| 11,022,394 | B1 * | 6/2021 | Kedairy | F41A 21/12 |
| 2012/0131836 | A1 | 5/2012 | Findlay | |
| 2016/0363425 | A1 * | 12/2016 | Minnicino, II | F42B 10/08 |
| 2020/0248997 | A1 | 8/2020 | McLaren et al. | |

* cited by examiner

CASELESS TAPERED-BORE AMMUNITION AND FIREARM

RELATED APPLICATIONS

None

FIELD

This invention relates to the field of firearms. More particularly, this invention relates to a tapered-bore firearm and a caseless ammunition cartridge therefor.

BACKGROUND

Traditionally, ammunition cartridges for small and medium caliber firearms have included a metallic case in which the propellant (gunpowder) is contained. When the ammunition is fired, the metallic case of the traditional cartridge is retained within the firing chamber until it is expelled during reloading. There has been significant effort in recent years to eliminate the metallic case from small and medium caliber firearms. The major advantages of case elimination are reductions in cartridge weight and volume.

The traditional metallic cartridge case serves multiple purposes. It provides:

a container to hold the propellant in place;

a mechanism to hold primer that initiates the propellant;

protection from environmental and handling damage;

safety from accidental combustion;

a heat sink to remove excess heat from the chamber;

a gas seal around the chamber and firing pin; and means for extraction and ejection of misfired cartridges.

Eliminating the metallic cartridge case requires the cartridge and/or the firearm to provide all these functions.

Previous attempts to eliminate the metallic cartridge case have used one of two approaches. In a first approach, the projectile serves as the cartridge case. This approach has the disadvantage of having limited propellant capacity and a projectile with low sectional density. As a result, the projectile typically has lower initial energy and loses velocity more rapidly, resulting in limited range. In a second approach, compacted consolidated propellant is attached to the projectile. As a result of the low structural integrity compared to a metallic cartridge case, the propellant is subject to environmental and handling damage. In addition, the risk of inadvertent combustion is increased. This approach also requires a more complex chamber to provide for misfire extraction and ejection. In both approaches, the gas seal function is designed into the firearm.

What is needed, therefore, is an approach to the elimination of the metallic cartridge case that combines features of both approaches described above with other technologies, thereby addressing each of their disadvantages.

SUMMARY

The above and other needs are met by a caseless tapered-bore (CTB) ammunition and tapered-bore firearm configured to fire the CTB ammunition.

Some preferred embodiments described herein are directed to a caseless ammunition cartridge that includes a unitary outer portion having a forward section, a central section and a rear section. The forward section has an aerodynamic profile defined by a forward surface of revolution having a first radius that increases from the front to the rear of the forward section. The rear section has a cylindrical profile with a second radius. The central section has a profile defined by a central surface of revolution having a third radius that transitions from the first radius of the forward section to the second radius of the rear section. An inner core is disposed within the unitary metallic outer portion on the center axis of the cartridge. The inner core has a front portion that is encased by the forward section of the unitary outer portion, and a cylindrical rear portion disposed within the central and rear sections of the unitary outer portion. The inner core has a fourth radius that is less than the second and third radii. An annular cavity is disposed between the unitary outer portion and the rear portion of the inner core, and a propellant is disposed within the annular cavity. A combustible seal, which is attached to a rear opening of the rear section of the unitary outer portion, covers the annular cavity to protect the propellant.

In some embodiments, the surface of revolution of the forward section of the unitary outer portion comprises a tangent ogive shape.

In some embodiments, the surface of revolution of the central section of the unitary outer portion comprises a conical shape.

In some embodiments, the rear surface of the inner core includes a primer cavity for holding primer, and the combustible seal covers the primer cavity to protect the primer.

In some embodiments, the unitary outer portion has an inner radius $r_{A1}$ and an outer radius $r_{A2}$ at the rear of the forward section, an inner radius $r_{B1}$ and an outer radius $r_{B2}$ within the central section, and an inner radius $r_{C1}$ and an outer radius $r_{C2}$ within the rear section, wherein $$(r_{A2}^2-r_{A1}^2)=(r_{B2}^2-r_{B1}^2)=(r_{C2}^2-r_{C1}^2).$$

In another aspect, embodiments of the invention are directed to a barrel for firing a caseless ammunition cartridge. One preferred embodiment of the barrel includes a chamber, an initial section, a tapered section and a rifled section. The chamber has a rear section with a rear section inner diameter and a forward section with a forward section inner diameter. The initial section has a cylindrical bore in communication with the chamber. The cylindrical bore has a cylindrical bore inner diameter that is less than the forward section inner diameter of the chamber. The tapered section has a tapered bore in communication with the cylindrical bore of the initial section. The tapered bore has a rear inner diameter matching the cylindrical bore inner diameter, which tapers down to a forward inner diameter that is less than the rear inner diameter. The rifled section has a rifled bore in communication with the tapered bore of the tapered section. The rifled bore has an inner diameter matching the forward inner diameter of the tapered bore.

In some embodiments, a bolt is received at least partially within the rear section of the chamber. The bolt has a forward outer section and an inner face disposed within the forward outer section. An inner gas seal is disposed within the forward outer section of the bolt and against the inner face. The inner seal comprises an inner circular disc portion and an outer portion. The inner circular disc portion has a rear surface disposed against the inner face of the bolt and has a central striker. The outer portion of the inner seal comprises a Belleville spring attached to an outer perimeter of the inner circular disc portion. The outer portion has a cylindrical lip inserted into the inner face of the bolt. A firing pin, which is disposed along a central axis of the bolt, is operable to contact the rear surface of the inner disc portion of the inner gas seal, thereby causing forward movement of the central striker with respect to the inner face of the bolt.

In some embodiments, a cylindrical outer gas seal is disposed around the forward outer section of the bolt. The outer gas seal has an outer diameter matching the inner diameter of the rear section of the chamber. The outer gas seal is configured to block passage of gas between an inner surface of the rear section of the chamber and the forward outer section of the bolt.

In some embodiments, the inner gas seal and the outer gas seal are fabricated from high-temperature spring material.

In yet another aspect, embodiments of the invention provide a method for operating a firearm, including the following steps:

(a) providing a caseless ammunition cartridge as described herein;
(b) providing a barrel as described herein;
(c) loading the caseless ammunition cartridge into the chamber of the barrel;
(d) igniting the propellant, thereby creating pressure in the chamber behind the caseless ammunition cartridge which propels the caseless ammunition cartridge into the cylindrical bore of the initial section of the barrel;
(e) consuming the propellant as the caseless ammunition cartridge travels through the cylindrical bore;
(f) propelling the caseless ammunition cartridge through the tapered bore of the tapered section of the barrel;
(g) collapsing the central and rear sections of the unitary outer portion onto the inner core as the caseless ammunition cartridge travels through the tapered bore of the tapered section of the barrel, thereby forming a projectile having an outer diameter matching the first radius at the rear of the forward section of the unitary outer portion; and
(h) propelling the projectile through the rifled bore of the rifled section of the barrel.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
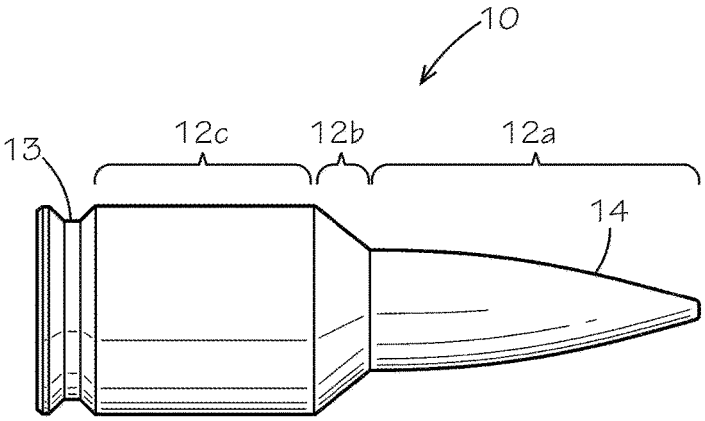
FIG. 1 depicts an unfired caseless tapered-bore (CTB) cartridge according to an embodiment of the invention.

FIGS. 1 and 2 depict a preferred embodiment of a caseless tapered bore (CTB) small arms cartridge 10 prior to firing. The unitary outer portion 14 of the cartridge 10 is a unitary metallic component comprising a forward section 12*a*, central section 12*b* and rear section 12*c*. The forward section 12*a* has an aerodynamic, tangent ogive shape similar to existing projectiles. The rear of the forward section 12*a* transitions to the hollow conical central section 12*b*. The rear of the central section 12*b* transitions to the cylindrical rear section 12*c*. The cylindrical rear section 12*c* is hollow and has an extraction groove 13 near its rear end.

In a preferred embodiment, the unitary outer portion 14 is formed from a copper alloy. The specific composition of the alloy would be determined by the cartridge purpose. For a 6.5 mm ball-type cartridge, an alloy with a density of 8.53 g/cm$^3$ (cartridge brass) would be specified. The copper alloy composition can be chosen to insure a consistent projectile weight for other types of cartridges, such as armor piercing and tracer cartridges.

Figure 2A:
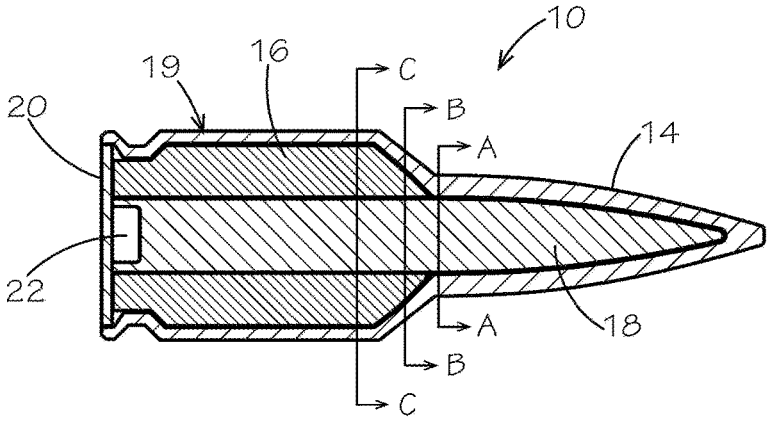
FIGS. 2A and 2B depict cross section views of the unfired CTB cartridge depicted in FIG. 1.

As shown in the cross-section view of FIG. 2A, a metallic inner core 18 is disposed on the central axis of the cartridge 10. In a preferred embodiment, the inner core 18 is formed from steel alloy, the specific composition of which is determined by the cartridge purpose. A mild steel would be acceptable for a ball-type cartridge. For a tracer cartridge, the steel inner core would include a cavity forward of the primer cavity that contains the tracer compound. A hardened steel alloy would be used for the inner core 18 in armor piercing applications. Thermally-consolidated propellant 16 is disposed around the inner core 18 within an annular cavity 19 formed by the rear and central sections 12*c* and 12*b*. A primer cavity 22 is disposed at the rear of the inner core 18. A combustible seal 20 is disposed over the primer cavity 22 and over the annular cavity 19 between the inner core 18 and the rear section 12*c* to protect the propellant 16 from environmental damage. In a preferred embodiment, the combustible seal 20 is formed from an epoxy resin.

Figure 2B:
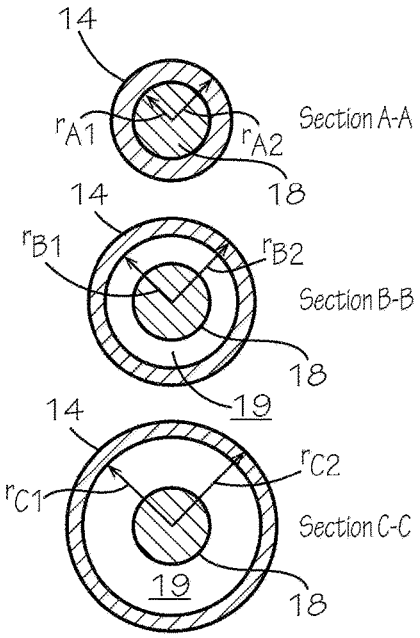
Figure 3:
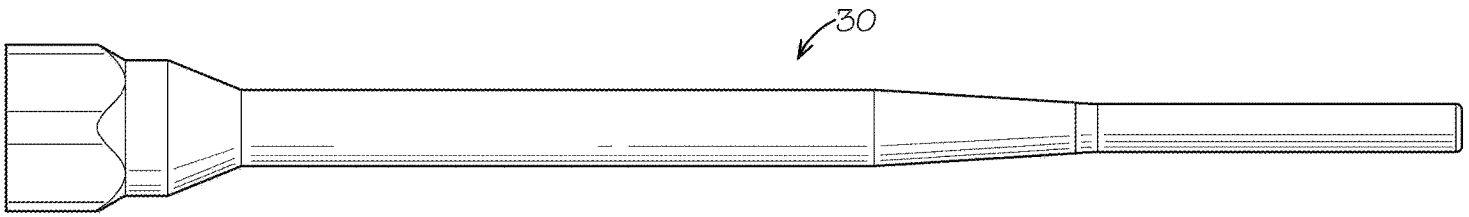
FIG. 3 depicts a CTB rifle barrel according to an embodiment of the invention.
Figure 4:
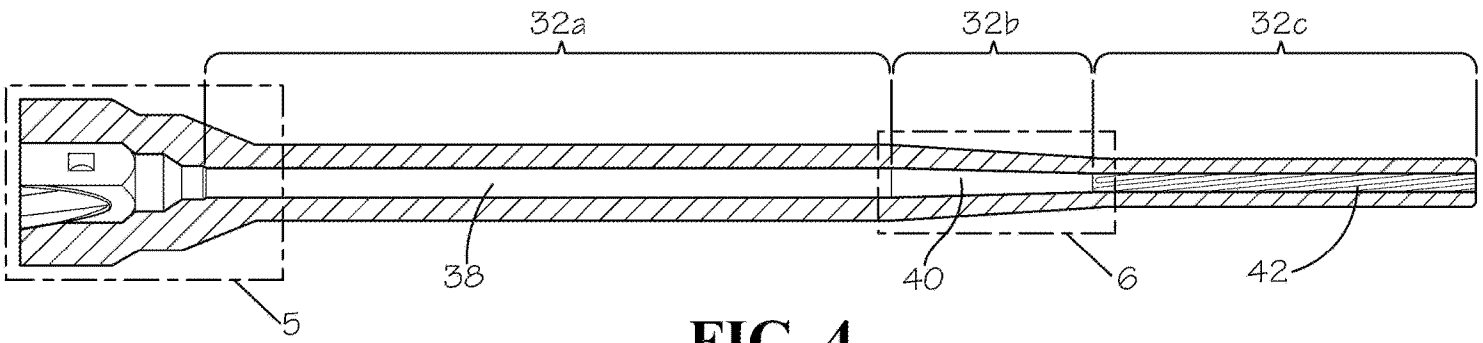
FIG. 4 depicts a cross-section view of the CTB rifle barrel depicted in FIG. 3.
Figure 6:
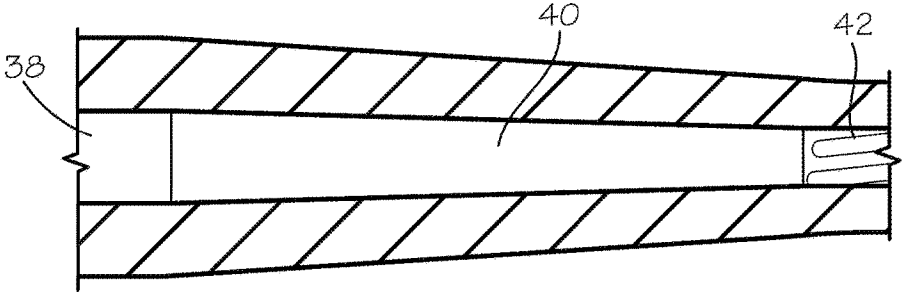
FIG. 6 depicts a zoomed-in cross-section view of a tapered portion of the CTB rifle barrel depicted in FIG. 4.

The outer radius of the inner core 18 and inner radii of the central section 12*b* and the rear section 12*c* are sized such that the cross-sectional areas, $A_b$ and $A_c$, of these sections of the outer portion 14 are identical—within an acceptable tolerance—to the cross-sectional area $A_a$ of the rear portion of the forward section 12*a* of the outer portion 14. With reference to FIG. 2B, $$A_a=\pi\times(r_{A2}^2-r_{A1}^2),$$

$A_b=\pi\times(r_{B2}^2-r_{B1}^2)$, and $A_c=\pi\times(r_{C2}^2-r_{C1}^2)$

Thus, in a preferred embodiment of the cartridge 10, $(r_{A2}^2-r_{A1}^2)=(r_{B2}^2-r_{B1}^2)=(r_{C2}^2-r_{C1}^2)$, so that $A_a=A_b=A_c$.

A preferred embodiment of a firearm barrel 30 configured for firing the cartridge 10 is depicted in FIGS. 3-8. The barrel 30 preferably includes a chamber 34, an initial section 32*a* having a cylindrical bore 38, a tapered section 32*b* having a tapered bore 40, and a rifled section 32*c* having a rifled bore 42.

Figure 5:
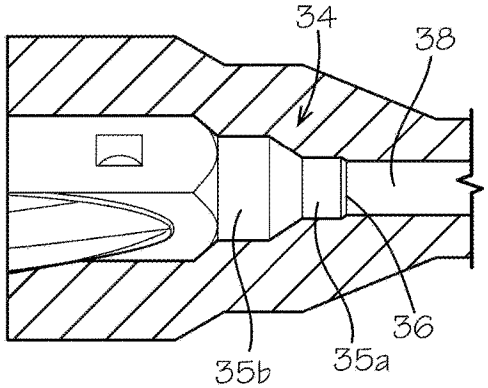
FIG. 5 depicts a zoomed-in cross-section view of a firing chamber of the CTB rifle barrel depicted in FIG. 4.
Figure 7:
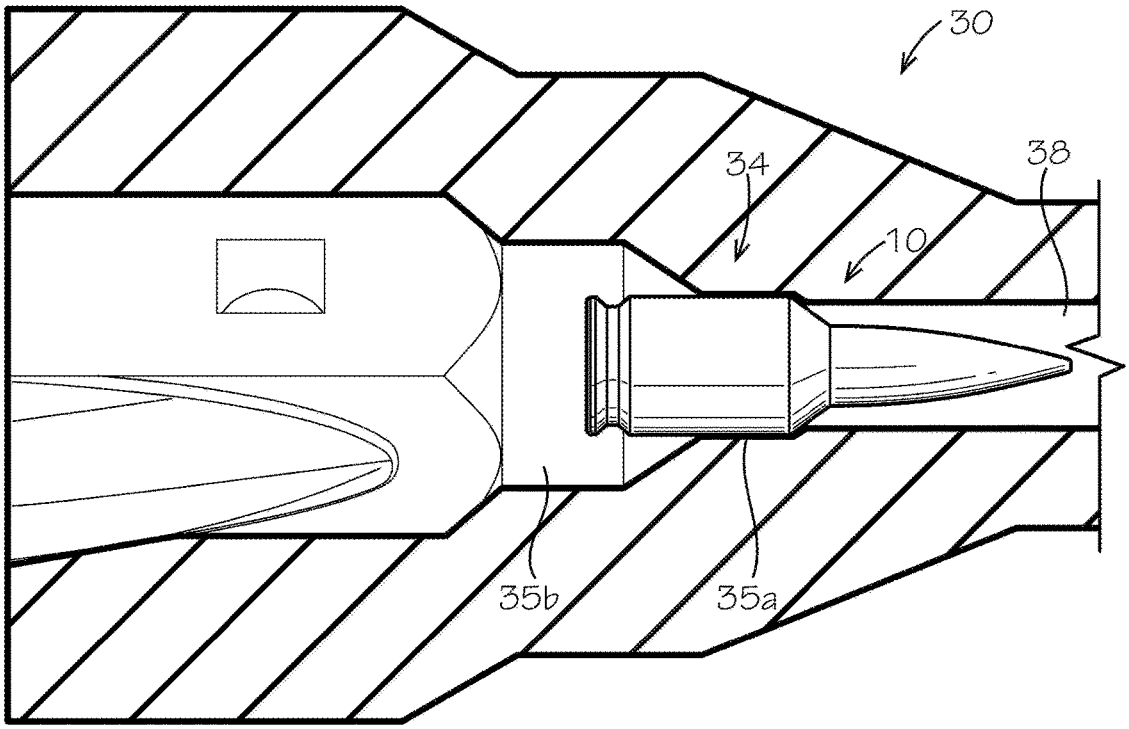
FIG. 7 depicts an unfired CTB rifle cartridge in the firing chamber of the CTB rifle barrel depicted in FIG. 4.

As shown in the cross-section views of FIGS. 5 and 7, the chamber 34 includes a cylindrical forward section 35*a* and a cylindrical rear section 35*b*. The diameter of the chamber forward section 35*a* is sized to allow a slip fit between the inner wall of the forward section 35*a* and the outer surface of the rear section 12*c* of the cartridge 10. In a preferred embodiment, the diameter of the chamber forward section is 11.3 mm (0.445 inch). Between the rear section 35*b* and the forward section 35*a* is a conical decrease in diameter to provide proper headspace for locating the cartridge 10 axially within the chamber 34. At the forward end of the forward section 35*a* is a step 36 that locates the cartridge 10 within the chamber 34 prior to firing.

In a preferred embodiment, the overall length of the barrel is 450 mm (17.72 inch), the diameter of the cylindrical bore 38 is 10.5 mm (0.413 inch) and its length is 250 mm (9.84 inch), the length of the tapered bore 40 is 76 mm (3.00 inch), and the length of the rifled bore is 124 mm (4.88 inch) and its diameter is 6.7 mm (0.264 inch).

When the propellant 16 is initiated, the cartridge 10 is forced past the step 36 in the chamber 34 by the increased pressure, and it enters the cylindrical bore 38 of the initial section 32*a* of the barrel 30. Most of the propellant 16 is consumed as the cartridge 10 travels through this initial section 32*a*. After the cartridge 10 has accelerated through the initial section 32*a*, the cartridge 10 enters the tapered bore 40 of the tapered section 32*b*, depicted in FIG. 6.

Figure 8:
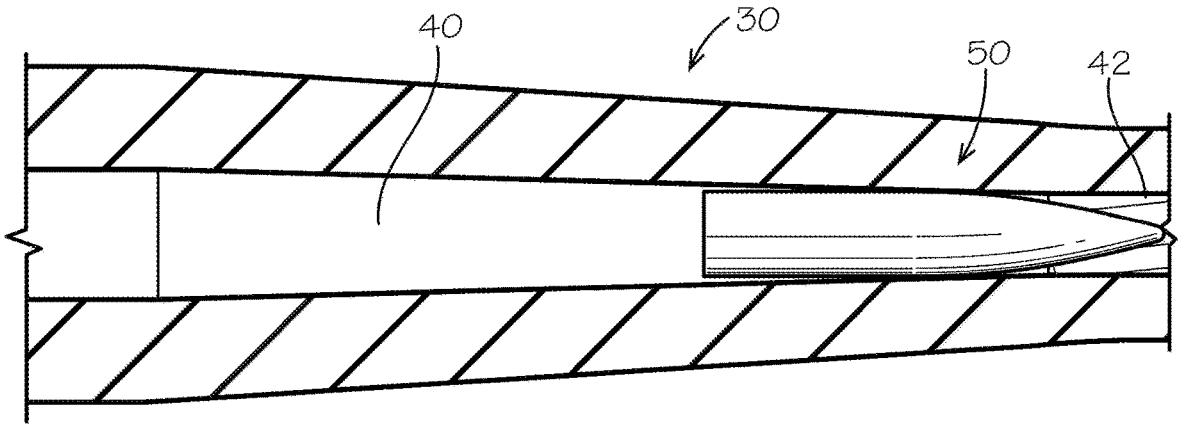
FIG. 8 depicts a CTB projectile after passing through the tapered portion of the CTB rifle barrel depicted in FIG. 4.
Figure 9:
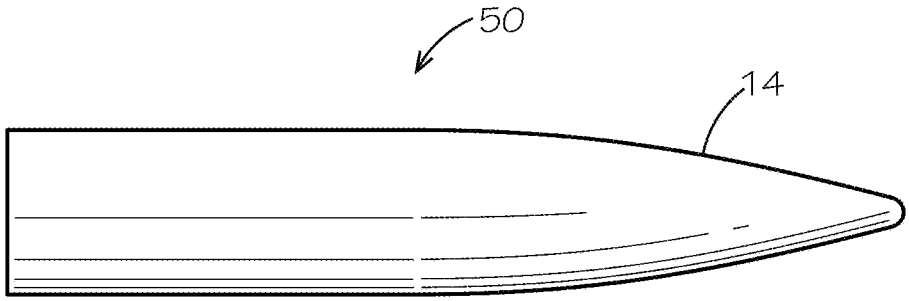
FIG. 9 depicts a CTB projectile after exiting a CTB rifle barrel according to an embodiment of the invention.
Figure 10:
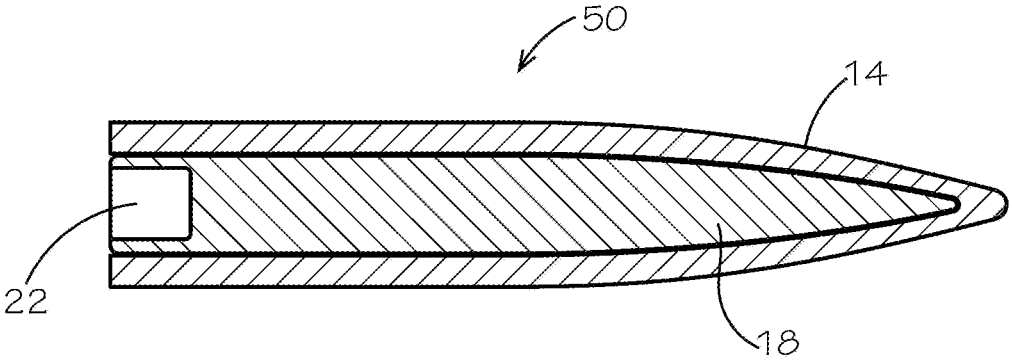
FIG. 10 depicts a cross-section view a CTB projectile after exiting a CTB rifle barrel according to an embodiment of the invention.

The initial inner diameter of the tapered bore 40 matches the inner diameter of the initial section 32*a*. As the cartridge 10 is forced through the tapered bore 40 by gas pressure, the outer diameter of the rear section 12*c* of the cartridge 10 is reduced to the inner diameter of the rifled bore 42, thereby collapsing the annular cavity 19. The resulting projectile 50 at the entrance to the rifled bore 42 is shown in FIG. 8. Because the cross-sectional area $A_c$ of the rear section 12*c* and the cross-sectional area $A_b$ of the central section 12*b* are identical to the cross-sectional area $A_a$ of the forward section 12*a*, the tapered bore 40 compresses the sections 12*c* and 12*b* down against the core 18 to form a projectile 50 having a solid cross-section with no internal void. FIG. 9 depicts the projectile 50 after passing through the tapered bore 40. The projectile 50 then enters the rifled bore 42 which provides spinning stabilization to the projectile 50 as it exits the barrel 30. FIG. 10 depicts a cross-section view of the projectile 50 after exiting the barrel 30.

Those of ordinary skill in the art will appreciate that the force that propels a projectile through a firearm barrel is a function of the pressure in the barrel multiplied by the area of the projectile base. Thus, a larger projectile base will result in greater force and greater acceleration for a given pressure and projectile weight. The relatively large base area of the CTB projectile 50, relative to its mass, results in improved propellant efficiency.

Figure 11:
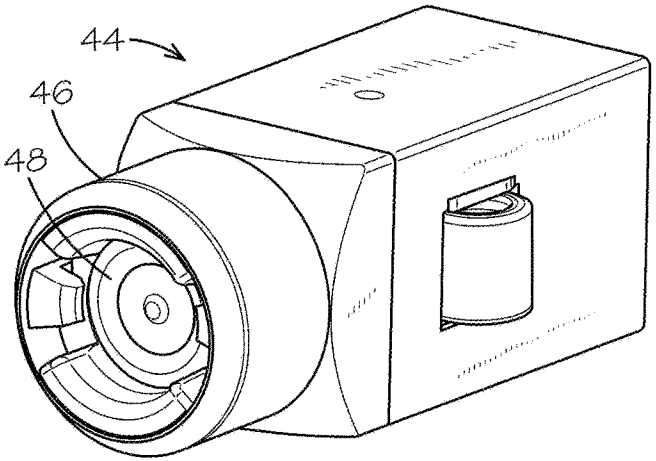
FIG. 11 depicts a front perspective view of a forward section of a bolt of a CTB rifle according to an embodiment of the invention.
Figure 12:
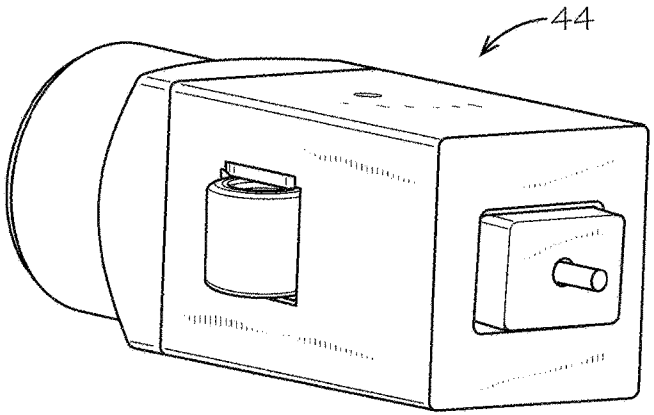
FIG. 12 depicts a rear perspective view of the forward section of the bolt depicted in FIG. 11.
Figure 13:
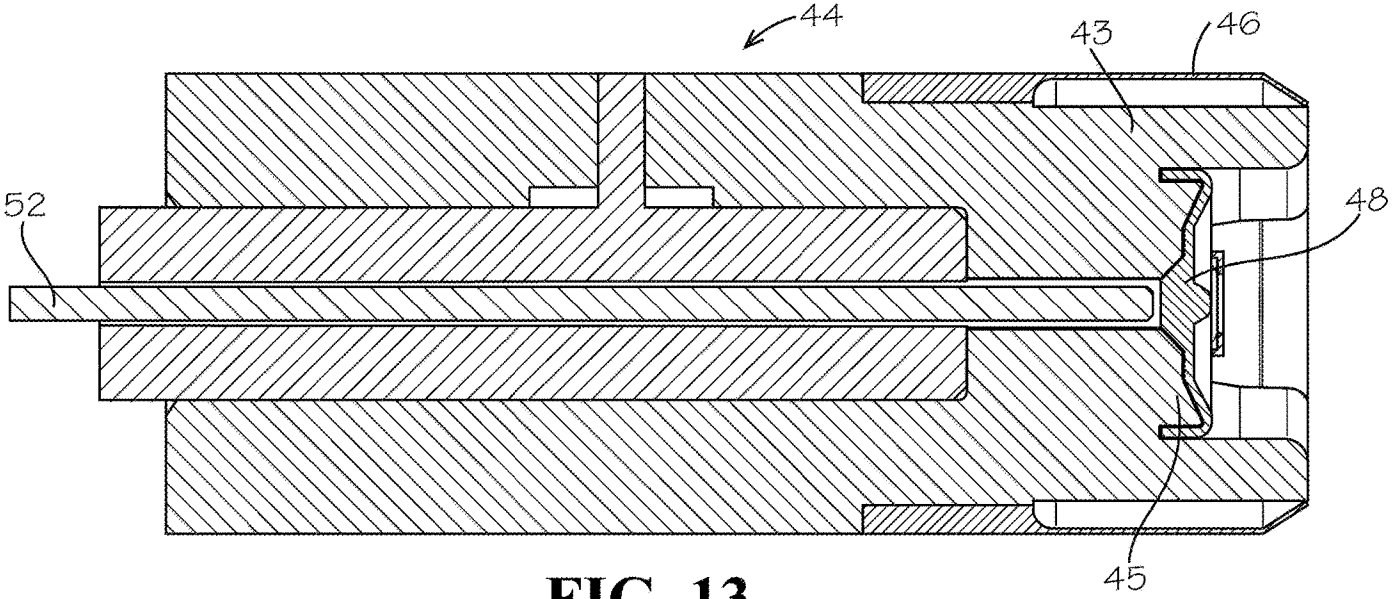
FIG. 13 depicts a cross-section view of the forward section of the bolt depicted in FIG. 11.

FIGS. 11-13 depict a bolt 44 configured for use with the barrel 30. Generally, the bolt 44 operates in a manner similar to typical firearm bolts, cycling forward to load the cartridge into the chamber 34 and backward after firing in preparation for loading another cartridge. As shown in the cross-section view of FIG. 13, the bolt 44 has a forward outer section 43 having a cylindrical outside profile disposed around an inner face 45. The firing pin 52 of the bolt 44 is configured to penetrate a central aperture in the inner face 45. A preferred embodiment of the bolt 44 includes two seals to prevent combustion gas from escaping past the bolt: an outer seal 46 and an inner seal 48.

Figure 14:
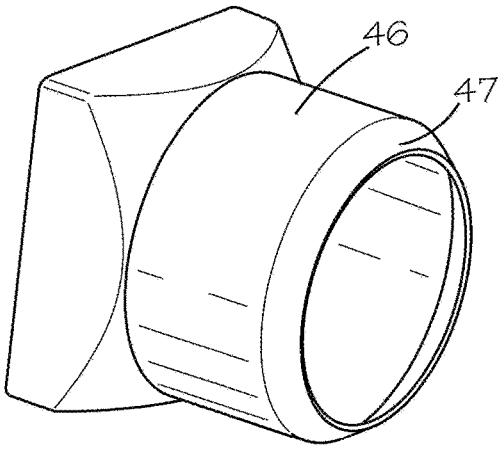
FIG. 14 depicts a front perspective view of an outer bolt seal of a bolt of a CTB rifle according to an embodiment of the invention.
Figure 15:
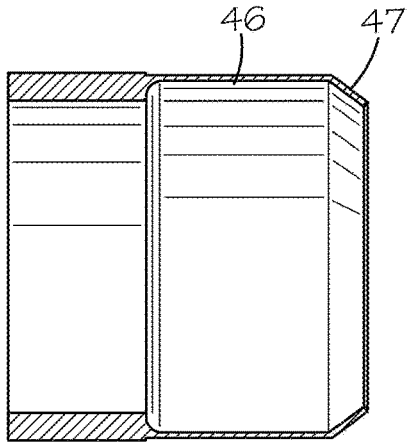
FIG. 15 depicts a cross-section view of the outer bolt seal depicted in FIG. 14.
Figure 16:
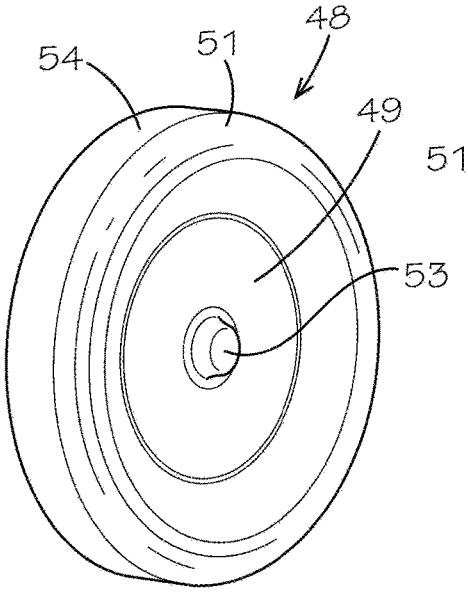
FIG. 16 depicts a front perspective view of an inner bolt seal of a bolt of a CTB rifle according to an embodiment of the invention.
Figure 17:
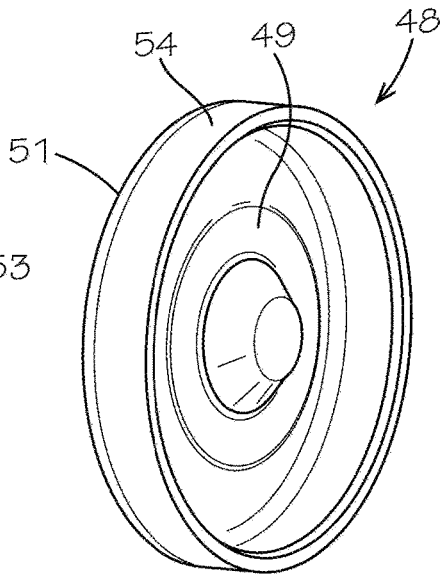
FIG. 17 depicts a rear perspective view of the inner bolt seal depicted in FIG. 16.
Figure 18:
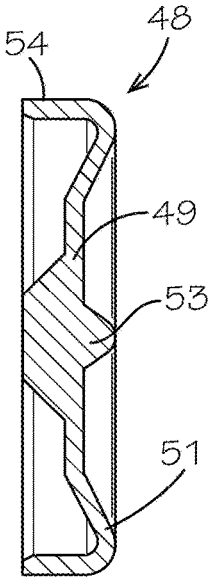
FIG. 18 depicts a cross-section view of the inner bolt seal depicted in FIG. 16.

As depicted in FIGS. 14 and 15, the outer seal 46 consists of a hollow cylinder fabricated from a high-temperature spring material. This cylindrical seal 46 is disposed around the forward outer section 43 of the bolt 44 and includes a forward conical section 47 that contacts the forward outer section 43 to provide a sealing capability similar to a typical metallic cartridge case. The use of a high temperature spring material allows the seal 46 to be used for millions of cycles.

As depicted in FIGS. 11, 12 and 16-18, the inner seal 48, which is also fabricated from high-temperature spring material, has a cylindrical lip 54 that inserts into a circular slot in the inner face 45 of the bolt 44. The outer portion 51 of the inner seal 48 comprises a Belleville spring that surrounds the cylindrical lip 54. An inner circular disc portion 49 of the inner seal 48 contains a central striker 53 to initiate the firing sequence. The inner seal 48 prevents gas leakage around the firing pin 52.

Preferred embodiments of the cartridge 10 provide all the functions of a conventional cartridge having a metallic case while significantly reducing the weight and volume. Further, the cartridge 10 provides:

- a cavity 19 within by the cylindrical and conical sections 12*c* and 12*b* for containing the propellant 16;
- a cavity 22 within the inner core 18 for containing the primer that initiates propellant combustion;
- protection of the propellant 16 from environmental and handling damage, which is provided by the cylindrical and conical sections 12*c* and 12*b* and the combustible environmental seal 20;
- safety from accidental combustion, provided by the rear cylindrical section 12*c* in a manner superior to other caseless concepts; and
- a heat sink that removes excess heat from the chamber—as the heated projectile 50 exits the barrel, heat is removed with it.

The barrel 30 and the bolt 44 function as well as or better than those used with traditional metallic cartridge cases, while providing:

- a gas seal around the chamber 34 and firing pin 52, wherein the cylindrical outer seal 46 around the outside of the bolt 44 and the inner seal 48 that includes a Belleville washer type spring 51 provide an efficient sealing system similar to that provided by a traditional metallic cartridge case; and
- extraction and ejection of misfired cartridges in a manner substantially identical to traditional metallic cartridge cases.

Computer analyses have been completed for several small caliber projectiles to validate the CTB cartridge concept. One such numerical analysis addressed a nominal 6.5 mm caliber firearm using the following parameters:

Chamber Diameter: 11.3 mm (0.445 inch)
Initial Barrel Diameter: 10.5 mm (0.413 inch)
Barrel Length @ 10.5 mm: 250 mm (9.84 inch)
Taper Length: 76 mm (3.00 inch)

Projectile Caliber: 6.7 mm (0.264 inch)
Overall Barrel Length: 450 mm (17.72 inch)
Maximum Pressure: 220 MPa (32,000 psi)
Projectile Weight: 8.0 grams (123 grains)
Propellant Weight: 1.4 grams (22 grains)

Figure 19:
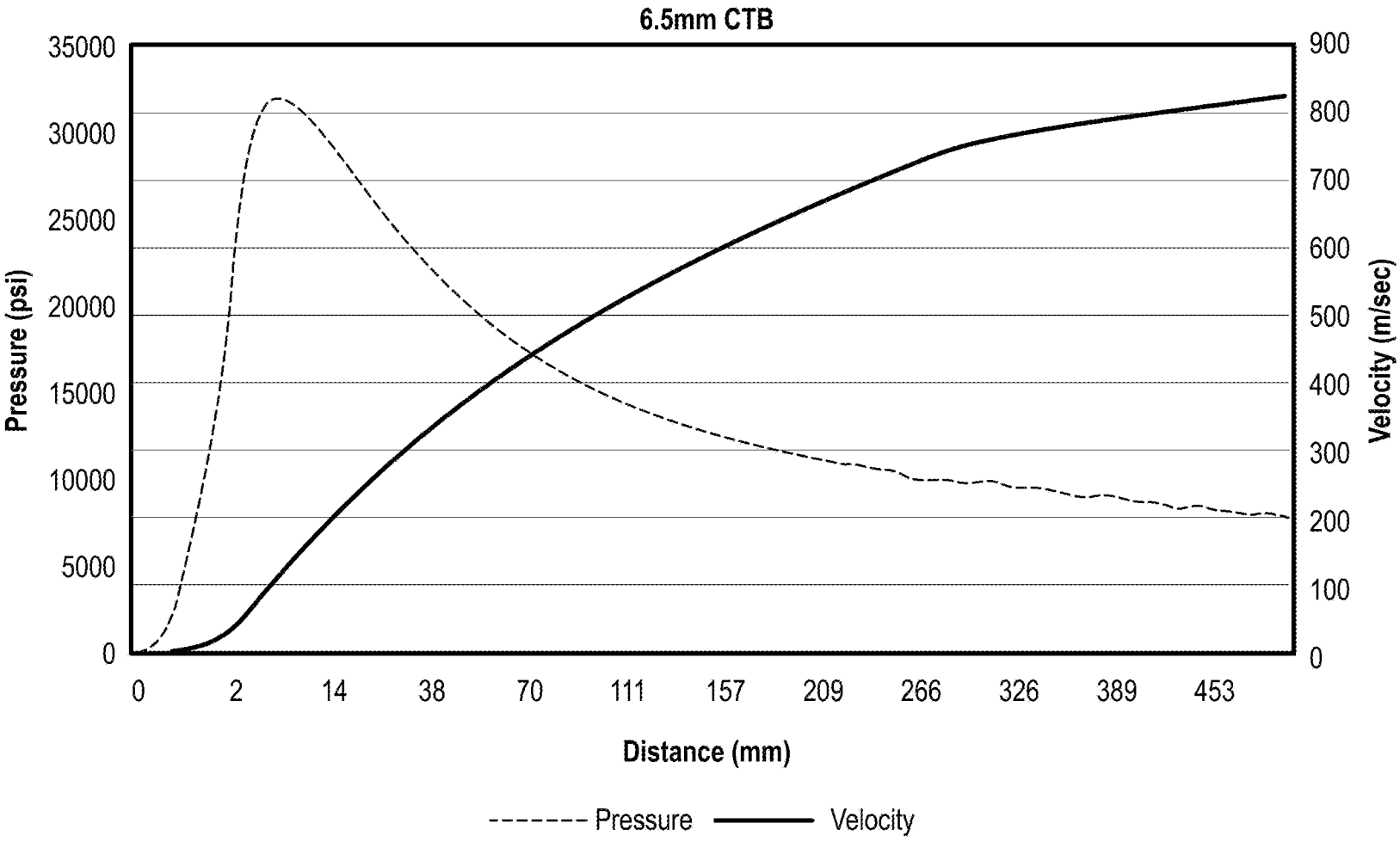
FIG. 19 depicts a plot of pressure and velocity versus distance of travel of a CTB projectile according to an embodiment of the invention.

Based on these parameters, the numerical analysis generated theoretical pressure and velocity performance curves for this conceptual design, as plotted in FIG. 19. The plotted data indicate that acceptable velocity and energy can be achieved with a peak pressure less than that of existing weapon/cartridge combinations.

The following table compares the characteristics and performance of the CTB cartridge and firearm described herein to the performance of a standard U.S. military individual weapon.

| Parameter | 5.56X45 NATO | 6.5 mm CTB |
|---|---|---|
| Nominal Caliber | 5.56 mm | 6.5 mm |
| Projectile Diameter | 5.7 mm (0.224") | 6.7 mm (0.264") |
| Projectile Weight | 4.0 grams (62 grains) | 8.0 grams (123 grains) |
| Sectional Density | 0.176 | 0.253 |
| Cartridge Weight | 12.3 grams (190 grains) | 9.4 grams (145 grains) |
| Cartridge Length | 57 mm (2.25") | 36 mm (1.42") |
| Cartridge Case Diameter | 9.6 mm (0.378) | 11.3 mm (0.445) |
| Maximum Pressure | 380 MPa (55,000 psi) | 220 MPa (32,000 psi) |
| Initial Velocity | 950 m/sec (508 mm barrel) | 800 m/sec (450 mm barrel) |
| Initial Energy | 1800 J (1370 lb-ft) | 2560 J (1888 lb-ft) |

The overall weight of the CTB cartridge is 23% less, while its initial projectile kinetic energy is 42% greater. Additionally, the space required for storage of an individual cartridge is reduced by 12%. The projectile sectional density of the CTB cartridge is 44% greater, resulting in increased effective range. For the CTB cartridge used in this comparison, the initial energy of the CTB projectile was limited to reduce recoil energy, thereby improving accuracy when fully automatic fire is required. The lower peak pressure to achieve this performance results in lower stresses on the barrel and bolt components. As a result, the overall weight of the CTB firearm can be less than the standard comparable weapon.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A caseless ammunition cartridge comprising:

a unitary metallic outer portion comprising:

a forward section having an aerodynamic profile defined by a forward surface of revolution disposed about a center axis of the cartridge, the forward surface of revolution having a first radius that increases from front to rear of the forward section;

a rear section having a cylindrical profile with a second radius; and a central section disposed between the forward section and the rear section, the central section having a profile defined by a central surface of revolution disposed about the center axis, the central surface of revolution having a third radius that transitions from the first radius of the forward section to the second radius of the rear section;

an inner core disposed within the unitary metallic outer portion on the center axis of the cartridge, the inner core having a front portion encased by the forward section of the unitary outer portion, and a cylindrical rear portion disposed within the central and rear sections of the unitary outer portion, and having a fourth radius that is less than the second and third radii;

an annular cavity disposed between the unitary outer portion and the rear portion of the inner core;

propellant disposed within the annular cavity; and a combustible seal attached to a rear opening of the rear section of the unitary outer portion, the combustible seal covering the annular cavity to protect the propellant.

2. The caseless ammunition cartridge of claim 1 wherein the profile of the forward section of the unitary outer portion is defined by the forward surface of revolution comprising a tangent ogive shape.

3. The caseless ammunition cartridge of claim 1 wherein the profile of the central section of the unitary outer portion is defined by the central surface of revolution comprising a conical shape.

4. The caseless ammunition cartridge of claim 1 wherein a rear surface of the inner core includes a primer cavity for holding primer, and the combustible seal covers the primer cavity to protect the primer.

5. The caseless ammunition cartridge of claim 1 wherein the unitary outer portion has:

an inner radius $r_{A1}$ and an outer radius $r_{A2}$ at the rear of the forward section;

an inner radius $r_{B1}$ and an outer radius $r_{B2}$ within the central section; and an inner radius $r_{C1}$ and an outer radius $r_{C2}$ within the rear section, wherein $$(r_{A2}^2-r_{A1}^2)=(r_{B2}^2-r_{B1}^2)=(r_{C2}^2-r_{C1}^2).$$

6. The caseless ammunition cartridge of claim 1 wherein the unitary outer portion is formed from a copper alloy.

7. The caseless ammunition cartridge of claim 1 wherein the inner core is formed from a steel alloy.

8. The caseless ammunition cartridge of claim 1 wherein the combustible seal is formed from epoxy resin.

9. A barrel for firing a caseless ammunition cartridge, the barrel comprising:

a chamber for receiving a caseless ammunition cartridge, the chamber having a rear section with a rear section inner diameter and a forward section with a forward section inner diameter an initial section having a cylindrical bore in communication with the chamber, the cylindrical bore having a cylindrical bore inner diameter that is less than the forward section inner diameter of the chamber;

a tapered section having a tapered bore in communication with the cylindrical bore of the initial section, the tapered bore having a rear inner diameter matching the cylindrical bore inner diameter, wherein the rear inner diameter tapers down to a forward inner diameter that is less than the rear inner diameter;

a rifled section having a rifled bore in communication with the tapered bore of the tapered section, the rifled bore having a rifled bore inner diameter matching the forward inner diameter of the tapered bore;

a bolt received at least partially within the rear section of the chamber, the bolt having a forward outer section and an inner face disposed within the forward outer section;

an inner gas seal disposed within the forward outer section of the bolt and against the inner face, the inner seal comprising;

an inner circular disc portion having a rear surface disposed against the inner face of the bolt and having a central striker; and an outer portion comprising a Belleville spring attached to an outer perimeter of the inner circular disc portion, the outer portion having a cylindrical lip inserted into the inner face of the bolt; and a firing pin disposed along a central axis of the bolt and penetrating the inner face of the bolt, the firing pin operable to contact the rear surface of the inner disc portion of the inner gas seal, thereby causing forward movement of the central striker with respect to the inner face of the bolt.

10. The barrel of claim 9, further comprising a cylindrical outer gas seal disposed around and contacting the forward outer section of the bolt, the outer gas seal having an outer diameter matching the inner diameter of the rear section of the chamber, the outer gas seal configured to block passage of gas between an inner surface of the rear section of the chamber and the forward outer section of the bolt.

11. The barrel of claim 10, wherein the inner gas seal and the outer gas seal are fabricated from high-temperature spring material.

12. A method for operating a firearm, comprising:

(a) providing a caseless ammunition cartridge comprising:

a unitary metallic outer portion comprising:

a forward section having an aerodynamic profile defined by a forward surface of revolution disposed about a center axis of the cartridge, the forward surface of revolution having a first radius that increases from front to rear of the forward section;

a rear section having a cylindrical profile with a second radius; and a central section disposed between the forward section and the rear section, the central section having a profile defined by a central surface of revolution disposed about the center axis, the central surface of revolution having a third radius that transitions from the first radius of the forward section to the second radius of the rear section;

an inner core disposed within the unitary metallic outer portion on the center axis of the cartridge, the inner core having a front portion encased by the forward section of the unitary outer portion, and a cylindrical rear portion disposed within the central and rear sections of the unitary outer portion, and having a fourth radius that is less than the second and third radii;

an annular cavity disposed between the unitary outer portion and the rear portion of the inner core;

propellant disposed within the annular cavity; and a combustible seal attached to a rear opening of the rear section of the unitary outer portion, the combustible seal covering the annular cavity to protect the propellant;

(b) providing a barrel comprising:

a chamber for receiving the caseless ammunition cartridge, the chamber having a rear section with a rear section inner diameter and a forward section with a forward section inner diameter;

an initial section having a cylindrical bore in communication with the chamber, the cylindrical bore having a cylindrical bore inner diameter that is less than the forward section inner diameter of the chamber;

a tapered section having a tapered bore in communication with the cylindrical bore of the initial section, the tapered bore having a rear inner diameter matching the cylindrical bore inner diameter, wherein the rear inner diameter tapers down to a forward inner diameter that is less than the rear inner diameter; and a rifled section having a rifled bore in communication with the tapered bore of the tapered section, the rifled bore having a rifled bore inner diameter matching the forward inner diameter of the tapered bore;

(c) loading the caseless ammunition cartridge into the chamber of the barrel;

(d) igniting the propellant, thereby creating pressure in the chamber behind the caseless ammunition cartridge that propels the caseless ammunition cartridge into the cylindrical bore of the initial section of the barrel;

(e) consuming the propellant as the caseless ammunition cartridge travels through the cylindrical bore;

(f) propelling the caseless ammunition cartridge through the tapered bore of the tapered section of the barrel;

(g) collapsing the central and rear sections of the unitary outer portion onto the inner core as the caseless ammunition cartridge travels through the tapered bore of the tapered section of the barrel, thereby forming a projectile having an outer diameter matching the first radius at the rear of the forward section of the unitary outer portion; and (h) propelling the projectile through the rifled bore of the rifled section of the barrel.

* * * * *